US006398704B1

(12) United States Patent
Shibuya et al.

(10) Patent No.: US 6,398,704 B1
(45) Date of Patent: Jun. 4, 2002

(54) OUTSIDE DIAMETER ADJUSTER FOR FOLDING CYLINDER

(75) Inventors: Kazuaki Shibuya, Kawasaki; Seiji Suzuki, Yokohama, both of (JP)

(73) Assignee: Kabushiki Kaisha Tokyo Kikai Seisakusho, Tokyo (JP)

( * ) Notice: Subject to any disclaimer, the term of this patent is extended or adjusted under 35 U.S.C. 154(b) by 0 days.

(21) Appl. No.: 09/575,466

(22) Filed: May 22, 2000

(30) Foreign Application Priority Data

May 21, 1999 (JP) ..... 11-141233

(51) Int. Cl.[7] ..... B31F 1/10

(52) U.S. Cl. ..... 493/424; 493/425; 493/479; 493/356; 493/432

(58) Field of Search ..... 493/466, 467, 493/471, 476, 428, 432, 356, 425, 479, 424

(56) References Cited

U.S. PATENT DOCUMENTS 5,571,069 A * 11/1996 Shah ..... 493/471

5,707,330 A * 1/1998 Kiamco et al. ..... 493/471

FOREIGN PATENT DOCUMENTS

| | | |
|---|---|---|
| JP | 2538925 | 7/1996 |
| JP | 2705922 | 10/1997 |
| JP | 2788321 | 6/1998 |

* cited by examiner

*Primary Examiner*—Rinaldi I. Rada
*Assistant Examiner*—Sameh Tawfik
(74) *Attorney, Agent, or Firm*—Foley & Lardner

(57) ABSTRACT

The present invention is directed to an outside diameter adjuster for a folding cylinder. The folding cylinder rotates about an axis and has a basic body having a columnar outer circumferential face, where an outer circumferential member forms one portion of the outer circumferential face of the basic body and is movable in a radial direction of the basic body by the angular displacement of an eccentric portion. The eccentric portion is angularly displaced by gears to which it is connected. These gears are connected to other gears, some of which are helical gears, that are configured to rotate and/or axially move in a manner such that the angular displacement of the eccentric portion can be totally controlled by the movement of the gears while the folding cylinder rotates.

8 Claims, 2 Drawing Sheets

OUTSIDE DIAMETER ADJUSTER FOR FOLDING CYLINDER

BACKGROUND OF THE INVENTION

1. Field of the Invention

This invention relates to an outside diameter adjuster for adjusting the outside diameter of a folding cylinder in accordance with the thicknesses of overlapped continuous papers in the folding cylinder of a folding portion of a rotary press for overlapping continuous papers printed in several printing sections and cutting and folding these continuous papers.

2. Description of the Related Art

An adjustment of the outside diameter of a folding cylinder in a folding portion of a rotary press in accordance with the thicknesses of overlapped continuous papers is well known as a means for setting produced folding binding to a preferable state irrespective of its thickness. For example, techniques described in Japanese Patents 2538925 (prior art 1), 2705922 (prior art 2) and 2788321 (prior art 3) are known.

The technique described in the prior art 1 is as follows. A sun gear has a rotating center common to that of a folding cylinder and can be rotated separately from the folding cylinder by selecting an aligning or unaligning state with the folding cylinder. The sun gear is engaged with a gear attached to a male screw shaft rotatably arranged near an inner circumferential face of the folding cylinder in parallel with an axis of the folding cylinder. The sun gear is rotated in the unaligning state with the folding cylinder so that the male screw shaft is rotated through the gear engaged with the sun gear. Thus, a slide base coupled to the male screw shaft by a screw is slid in parallel with the axis of the folding cylinder. A cam mechanism is constructed by an inclining groove arranged in the slide base and a cam follower inserted into the inclining groove. A slide plate attaching the cam follower thereto is slid in a direction perpendicular to a sliding direction of the slide base through the cam mechanism. One end of a thin plate-shaped member is connected to the slide plate and the other end of the thin plate-shaped member is connected to the folding cylinder. This thin plate-shaped member is curved by sliding the slide plate such that the thin plate-shaped member swells outside an outer circumferential face of the folding cylinder. The thin plate-shaped member also extends along the outer circumferential face of the folding cylinder by sliding the slide plate.

The technique described in the prior art 2 is as follows. A drive shaft has a rotating center common to that of a folding cylinder and is arranged in a hollow portion of a folding cylinder shaft so as to rotate separately from the folding cylinder by selecting an aligning or unaligning state with the folding cylinder. This drive shaft is rotated in the unaligning state with the folding cylinder through a drive gear attached to this drive shaft so that a female screw shaft is rotated. The female screw shaft is connected to the drive shaft through a pair of umbrella gears and is rotatably arranged along a radial direction of the folding cylinder. Further, a male screw shaft screw-coupled to the female screw shaft is moved in its axial direction by rotating the female screw shaft so that an operating shaft is angularly displaced. The operating shaft is connected to the male screw shaft through a link mechanism and is rotatably arranged near an inner circumferential face of the folding cylinder in parallel with an axis of the folding cylinder. A connecting link is connected to the operating shaft through an upper projection of the operating shaft and is arranged in the folding cylinder so as to move along an outer circumferential face of the folding cylinder. The connecting link is moved along the outer circumferential face of the folding cylinder by the angular displacement of the operating shaft. One end of a thin plate-shaped member is connected to this connecting link and the other end of the thin plate-shaped member is connected to the folding cylinder. The thin plate-shaped member is curved outside the outer circumferential face of the folding cylinder and extends along the outer circumferential face of the folding cylinder by moving the connecting link along the outer circumferential face of the folding cylinder.

The technique described in the prior art 3 is as follows. An adjusting ring has the same rotating center as the rotating center of a folding cylinder in which a folding jaw is arranged. The adjusting ring can be rotated integrally with the folding cylinder and is arranged in the folding cylinder so as to change a rotating phase. A rack is arranged on an outer circumferential side of the adjusting ring. A drive gear is engaged with the rack. The drive gear is attached to an eccentric shaft rotatably arranged near an inner circumferential face of the folding cylinder in parallel with an axis of the folding cylinder. An adjusting gear is attached to the output shaft of a motor arranged within the folding cylinder and is engaged with an inner gear series of the adjusting ring. The eccentric shaft is angularly displaced through the drive gear engaged with the rack of the adjusting ring by changing the rotating phase of the adjusting ring with respect to the folding cylinder through the adjusting gear. Further, the outside face of an arc member is covered with a resilient lining. The arc member is arranged such that an outside face of the resilient lining is in conformity with an outer circumferential face of the folding cylinder. Further, one end of the arc member is rotatably attached around an axis parallel to that of the folding cylinder, and the other end of the arc member is pressed against an eccentric circumferential face by spring force. The other end side of the arc member covered with the resilient lining is projected outside the outer circumferential face of the folding cylinder and is returned to a state along the outer circumferential face of the folding cylinder by the angular displacement of the eccentric shaft.

The prior arts 1 to 3 have the following several problems to be solved. The prior art 1 is constructed by a combination of a screw coupling mechanism of the slide base and the male screw shaft arranged in parallel with the axis of the folding cylinder, a slide mechanism of the slide base and the slide plate, a cam mechanism of the inclining groove of the slide base and the cam follower of the slide plate, etc. Therefore, this construction is relatively complicated and the number of parts is increased. Further, there are many parts requiring high processing accuracy to obtain a smooth sliding operation. Therefore, problems exist in that initial cost is high and breakdown frequency tends to be high and the number of processes is increased in maintenance and repair works. Furthermore, a problem exists in that mechanical energy loss is large since many sliding operations are used.

The prior art 2 is constructed by a combination of an umbrella gear mechanism for connecting the drive shaft and the female screw shaft, a screw connecting mechanism of the female screw shaft and the male screw shaft, a link mechanism for connecting the male screw shaft and the operating shaft, a connecting mechanism to the connecting link using an upper projection formed in the operating shaft, a sliding mechanism of the connecting link, etc. Therefore, this construction is very complicated and the number of parts is large, and parts of high processing accuracy are also required to obtain a smooth sliding operation. Therefore, problems exist in that initial cost is high and breakdown frequency is high and the number of maintenance and repair processes is large. Furthermore, a problem exists in that mechanical energy loss is increased by a sliding operation.

Further, in the above prior arts 1 and 2, the thin plate-shaped member is constructed such that this thin plate-shaped member is repeatedly curved and extended. Therefore, a repeating load is applied to the thin plate-shaped member so that the thin plate shaped member is fatigued and possibility of damage of this thin plate-shaped member is high. Therefore, frequent maintenance and management are required to prevent this damage.

In the prior art 3, the adjusting ring having outer and inner gears is attached to the folding cylinder, and the motor for angularly displacing the adjusting ring is arranged within the folding cylinder. Therefore, electric mounting parts such as a slip ring, etc. are required, and it is necessary to arrange and wire the motor so as to bear centrifugal force caused by rotating the folding cylinder so that initial cost is increased. Further, it is difficult to secure a space for arranging the motor within the folding cylinder into which the folding jaw and its operating mechanism, etc. are assembled. It is also necessary to arrange a balance weight or a member corresponding to this balance weight in accordance with the arrangement of the motor. Therefore, a problem exists in that unreasonableness and useless tend to be caused in design and manufacture.

Further, in the mechanism of the prior art 3, the arc member is projected outside the outer circumferential face of the folding cylinder by angularly displacing the eccentric shaft and is returned to a state along the outer circumferential face of the folding cylinder. Therefore, a problem exists in that adjusting accuracy is reduced by backlash in engagements of the respective gears for displacing the eccentric shaft.

SUMMARY OF THE INVENTION

To solve the above problems, the present invention proposes an outside diameter adjuster of a folding cylinder characterized in that the outside diameter adjuster comprises a basic body having a columnar outer circumferential face; a basic body rotating shaft rotated integrally with the basic body; a first gear rotated integrally with the basic body rotating shaft; a fourth gear having the same rotating center as the basic body rotating shaft and rotatable with respect to the basic body rotating shaft, and an outside diameter adjusting operating mechanism in which this mechanism has a second gear engaged with the first gear and also has a third gear engaged with the fourth gear and rotating centers of the second and third gears are set to the same rotating center, and the second and third gears are integrally rotated and can be moved in an axial direction of this rotating center; the basic body has a groove, an angular displaceable shaft arranged in the groove and angularly displaceable within the basic body in parallel with the basic body rotating shaft, angular displacing force giving means for giving force for angularly displacing the angular displaceable shaft in one direction at any time, an eccentric portion angularly displaced integrally with the angular displaceable shaft, and an outer circumferential member forming one portion of the outer circumferential face of the basic body and movable in a radial direction of the basic body by the angular displacement of the eccentric portion; a sixth gear rotatable integrally with the angular displaceable shaft is arranged in this angular displaceable shaft; a fifth gear is engaged with the sixth gear and has the same rotating center as the basic body rotating shaft and the fourth gear and is rotated integrally with the fourth gear and is arranged such that a rotating phase of the fifth gear with respect to the basic body can be changed; and at least one of a gear pair of the first and second gears engaged with each other and a gear pair of the third and fourth gears is mutually constructed by helical gears.

In the above outside diameter adjuster of the folding cylinder, it is also proposed that all of the first, second, third and fourth gears are helical gears. In the above outside diameter adjuster of the folding cylinder, it is also proposed that torsional directions of teeth of the first and fourth gears are set to the same direction. In the above outside diameter adjuster of the folding cylinder, it is further proposed that the second and third gears are an integrated gear having a wide tooth width.

In the above outside diameter adjuster of the folding cylinder, it is also proposed that torsional directions of teeth of the first and fourth gears are set to reverse directions. In the above outside diameter adjuster of the folding cylinder, it is further proposed that the second and third gears are double helical gears having a suitable middle groove.

DETAILED DESCRIPTION OF THE PREFERRED EMBODIMENT

Figure 1:
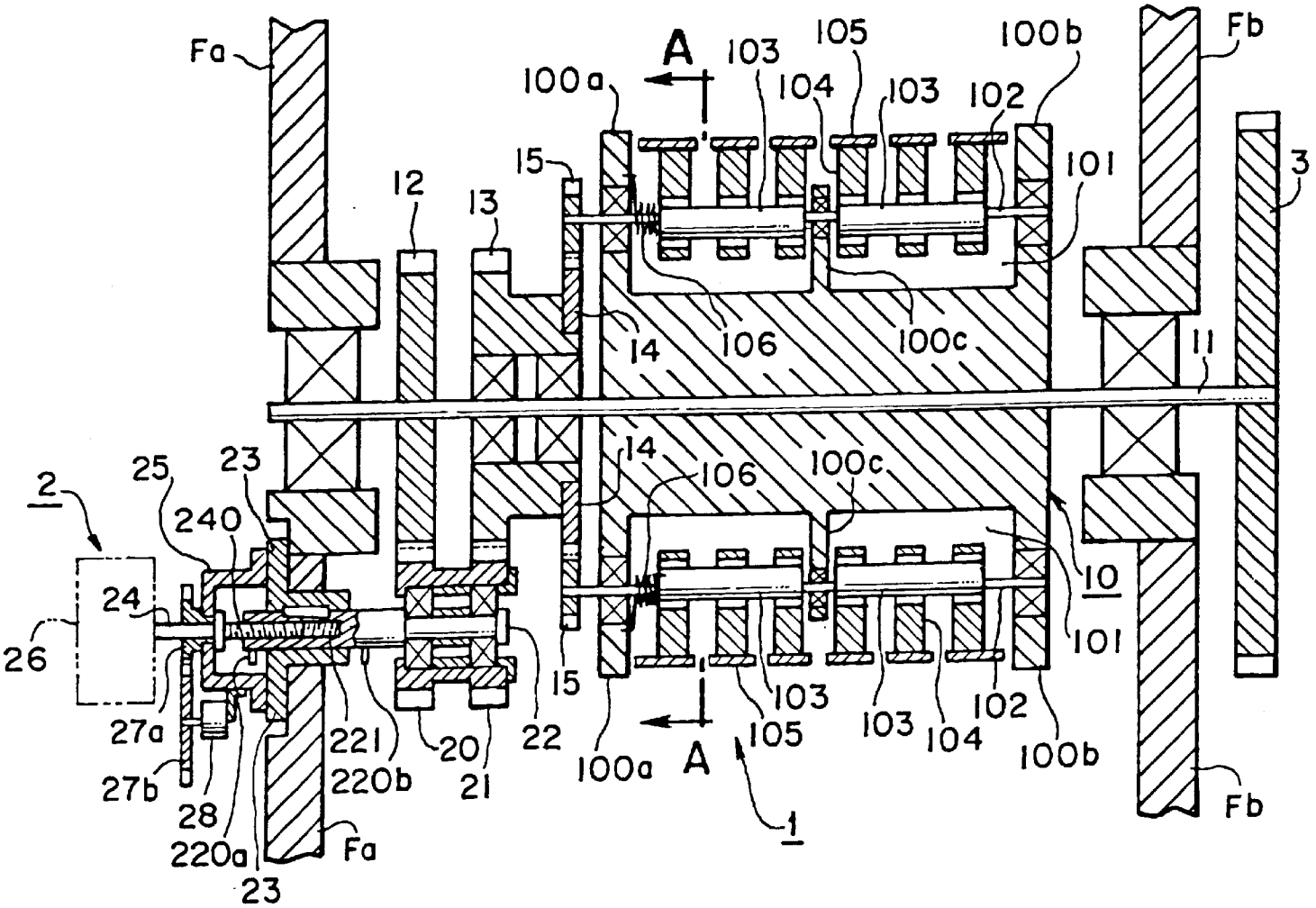
FIG. 1 is a schematic parallel sectional view of a folding cylinder showing an embodiment mode of this invention.
Figure 2:
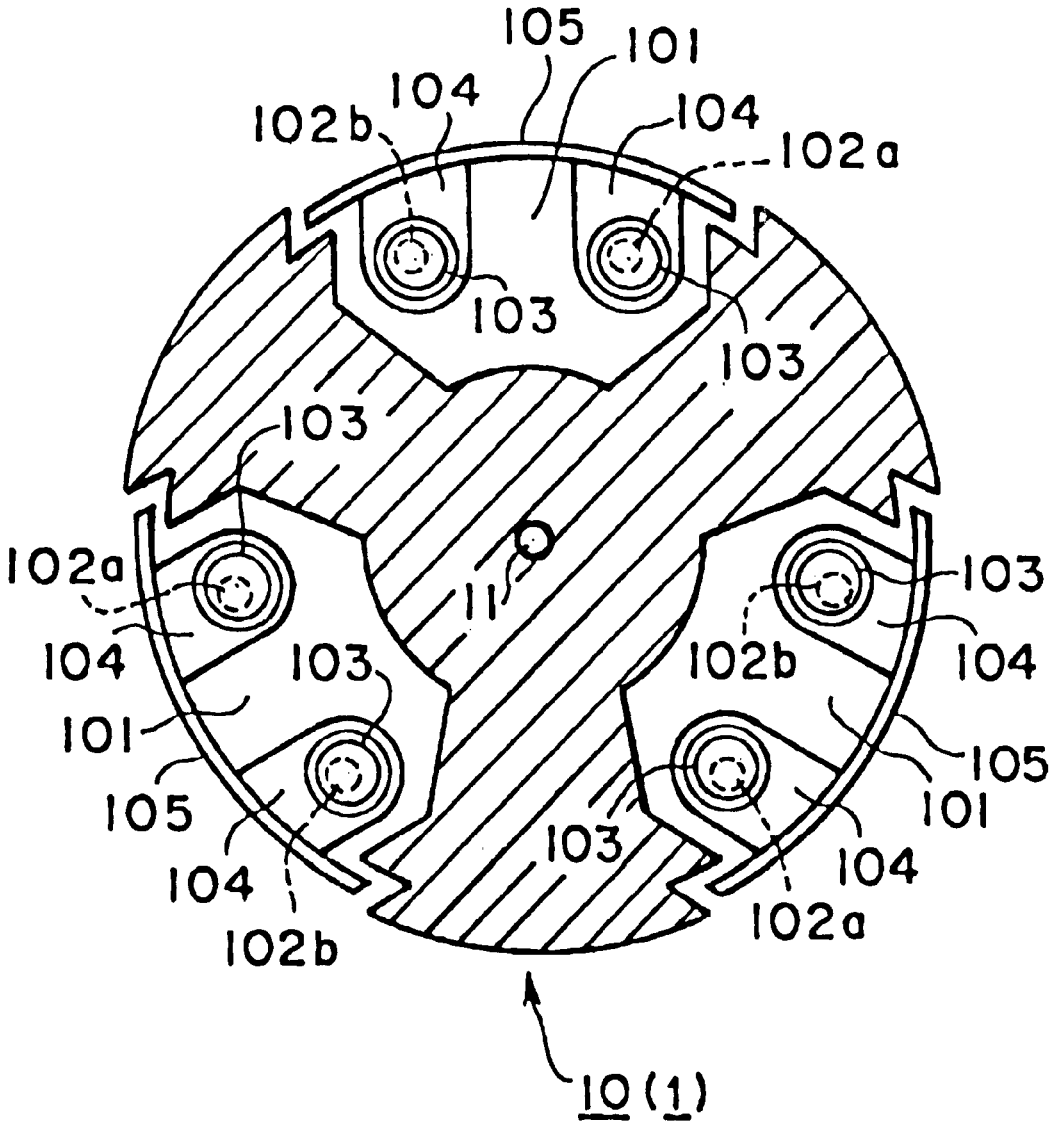
FIG. 2 is a view taken along an arrow line AA of FIG. 1.

The present invention will next be explained on the basis of FIG. 1 showing a schematic parallel sectional view showing an embodiment mode of a folding cylinder 1 in this invention and FIG. 2 showing a view taken along an arrow line AA of FIG. 1.

A folding cylinder 1 has a basic body 10 as a main portion having a columnar outer circumferential face, a basic body rotating shaft 11 rotated integrally with the basic body 10, and a first gear 12 rotated integrally with the basic body rotating shaft 11. The folding cylinder 1 also has a fourth gear 13 and a fifth gear 14. The fourth gear 13 has at least the same pitch circle as the first gear 12 and also has the same rotating center as the basic body rotating shaft 11 and can be rotated with respect to the basic body rotating shaft 11. The fifth gear 14 has the same rotating center as the fourth gear 13 and is rotated integrally with the fourth gear 13. The basic body rotating shaft 11 is rotatably supported by frames Fa, Fb and a driven gear 3 is attached to a portion projected outward from the frame Fb. The basic body rotating shaft 11 can be rotated by driving force from an unillustrated driving means through the driven gear 3.

The first gear 12, the fourth gear 13 and the fifth gear 14 are arranged sequentially from a side of the frame Fa in the basic body rotating shaft 11 between the basic body 10 and the frame Fa. One or both of the fourth gear 13 and the first gear 12 are constructed by helical gears.

Plural grooves 101 parallel to the basic body rotating shaft 11 are formed between side plates 100*a* and 100*b* arranged on both sides of the basic body 10 in its axial direction such that these grooves 101 are opened on the outer circumferential face of the basic body 10. In this embodiment mode, the number of grooves 101 is set to three. A pair of shafts 102*a*, 102*b* are arranged in each of the three grooves 101 such that these shafts 102*a*, 102*b* can be angularly displaced between the side plates 100*a* and 100*b* on both the sides of the basic body 10 and can be also angularly displaced in an intermediate supporting portion 100*c*. One end of each of the shafts 102*a*, 102*b* is projected outward from the side plate 100*a*. A sixth gear 15 is arranged in a projecting portion of each of the shafts 102*a*, 102*b* from the side plate 100*a*. The sixth gear 15 can be angularly displaced and rotated integrally with each of the shafts 102*a*, 102*b* . An eccentric portion 103 is arranged between the intermediate supporting portion 100*c* of each of the shafts 102*a*, 102*b* and each of the side plates 100*a*, 100*b* on both the sides of the basic body 10 such that the eccentric portion 103 is angularly displaced integrally with the shafts 102*a*, 102*b*.

Plural block members 104 are arranged in the eccentric portion 103 of each of the shafts 102*a*, 102*b* so as not to be rotated with respect to the angular displacement of the eccentric portion 103. In this embodiment mode, the number of block members 104 arranged in the eccentric portion 103 of each of the shafts 102*a*, 102*b* is set to six. Each of the block members 104 is relatively arranged in the pair of shafts 102*a*, 102*b*. An outer circumferential member 105 is wound between a pair of block members 104 and 104 corresponding to each other. Each outer circumferential member 105 has an outer circumferential face approximately aligned with the columnar outer circumferential face of the basic body 10 in a state in which the outer circumferential member 105 is attached to the pair of block members 104, 104.

An angular displacing force giving means 106 is attached 20 to each of the shafts 102*a*, 102*b* and gives force for angularly displacing each of these shafts in one direction at any time. In this embodiment mode, the angular displacing force giving means 106 is constructed by a torsion spring arranged between a side face of the eccentric portion 103 and an inside face of the side plate 100*a*. This torsion spring is approximately arranged concentrically with respect to each of axes of the shafts 102*a*, 102*b*.

Further, the sixth gear 15 arranged in an end portion of each of the shafts 102*a*, 102*b* projected outside the side plate 100*a* is engaged with the fifth gear 14. Rotating phases of the two shafts 102*a*, 102*b* are approximately in conformity with each other every pair in a state in which the sixth gear 15 is engaged with the fifth gear 14. Further, the height of an arc outer circumferential face of the outer circumferential member 105 attached to three pairs of shafts 102*a*, 102*b* through the block members 104 is approximately in conformity with that of the columnar outer circumferential face of the basic body 10.

An outside diameter adjusting operating mechanism 2 is operated in association with the first gear 12 and the fourth gear 13. The outside diameter adjusting operating mechanism 2 has a second gear 20 and a third gear 21 integrally arranged. The second gear 20 is engaged with the first gear 12 and the third gear 21 is engaged with the fourth gear 13. At least one of a gear pair of the first gear 12 and the second gear 20 engaged with each other and a gear pair of the third gear 21 and the fourth gear 13 engaged with each other is mutually constructed by helical gears. In this embodiment mode, all of the first gear 12, the second gear 20, the third gear 21 and the fourth gear 13 are constructed by helical gears and both the gear pairs are mutually constructed by helical gears. In this embodiment mode, torsional directions of teeth of the first gear 12 and the fourth gear 13 are set to the same direction. However, in another embodiment mode, the torsional directions of the teeth of the first gear 12 and the fourth gear 13 may be also set to reverse directions.

The second gear 20 and the third gear 21 of the outside diameter adjusting operating mechanism 2 can be rotated with respect to a supporting shaft 22 and are axially fixed to the supporting shaft 22 such that the second gear 20 and the third gear 21 are moved integrally with the supporting shaft 22. The second gear 20 and the third gear 21 may be also formed by a series of gears having a wide tooth width in which the second gear 20 and the third gear 21 are integrated with each other in another embodiment mode. In another embodiment mode, the second gear 20 and the third gear 21 may be also constructed by double helical gears having a suitable middle groove. In this case, torsional directions of teeth of the first gear 12 and the fourth gear 13 are set to reverse directions.

Both end portions of the supporting shaft 22 are projected to a sleeve 23 attached to the frame Fa and the supporting shaft 22 cannot be rotated and can be moved in an axial direction. Stoppers 220*a*, 220*b* are arranged in suitable positions on outer circumferential faces of projecting portions of the supporting shaft 22 projecting from the sleeve 23 to its both sides and are projected from these outer circumferential faces. A moving amount of the supporting shaft 22 in the axial direction is limited since the stoppers 220*a*, 220*b* come in contact with both the side faces of the sleeve 23.

A female screw portion 221 opened toward an outer side of the frame Fa is formed in the axial direction in the supporting shaft 22. The female screw portion 221 is screw-connected to a male screw portion 240 of a male screw member 24. The male screw member 24 is rotatably arranged in a supporting bracket 25 attached to the frame Fa through the sleeve 23 such that no male screw member 24 can be moved in the axial direction. The male screw member 24 is connected to an operating means 26 by an end portion of the male screw member 24 on a side opposed to the male screw portion 240. The operating means 26 is a rotating device of the male screw member constructed by a handle for a manual operation, or a device for an electric operation, etc. Reference numerals 27*a* , 27*b* designate gears for a potentiometer engaged with each other. The gear 27*a* for a potentiometer is rotated integrally with the male screw member 24 and the gear 27*b* for a potentiometer is attached to the rotating shaft of a potentiometer 28.

A holding mechanism for holding paper, a folding blade operating mechanism, a timing adjusting mechanism, etc. are arranged in the folding cylinder 1 to introduce overlapped papers as a folding object onto the outer circumferential face of the folding cylinder 1. The folding blade operating mechanism pushes up a folding portion of the overlapped papers to be folded by a folding blade projecting from the outer circumferential face of the folding cylinder 1. The timing adjusting mechanism adjusts timing of operations of these mechanisms. However, these mechanisms do not directly relate to this invention. Accordingly, descriptions and drawings of these mechanisms are omitted here.

An operation of the outside diameter adjuster in the embodiment mode of this invention will next be explained. The folding cylinder 1 is rotated by the driven gear 3 rotated by an unillustrated driving means and folds overlapped papers in cooperation with an adjacent drum such as an engaging drum, etc. In this operation, the first gear 12 attached to the basic body rotating shaft 11 is rotated in alignment with the basic body 10 of the folding cylinder 1. Similar to the first gear 12, the fourth gear 13 rotatably attached to the basic body rotating shaft 11 is rotated in alignment with the basic body 10 of the folding cylinder 1 since rotation is transmitted to the fourth gear 13 through the second gear 20 engaged with the first gear 12 and the third gear 21 rotated integrally with the second gear 20. At this time, the sixth gear 15 engaged with the fifth gear 14 rotated integrally with the fourth gear 13 is attached to the basic body 10 rotated at the same angular velocity as the angular velocity of the fifth gear 14. Therefore, no sixth gear 15 itself is rotated and no shafts 102*a*, 102*b* each attaching the sixth gear 15 thereto are rotated.

In this operation, when the adjustment of an outside diameter of the folding cylinder 1 is required in accordance with thicknesses of the overlapped papers, this outside diameter is adjusted by the outside diameter adjusting operating mechanism 2 as described below. First, the male screw member 24 is rotated by the operating means 26 in a suitable direction. The unrotatable supporting shaft 22 having the female screw portion 221 screw-connected to the male screw portion 240 is moved in the axial direction by a screw action by rotating the male screw member 24. A moving amount of this supporting shaft 22 in the axial direction is limited by making the stoppers 220*a*, 220*b* come in contact with the sleeve 23.

The second gear 20 and the third gear 21 axially fixed and attached to the supporting shaft 22 are moved integrally with the supporting shaft 22 by moving the supporting shaft 22 in the axial direction. On the other hand, the first gear 12 is fixed to the basic body rotating shaft 11 together with the basic body 10 and a rotating phase of this first gear 12 is set by rotation of the driven gear 3. However, the fourth gear 13 can be rotated with respect to the basic body rotating shaft 11 so that a rotating phase of the fourth gear 13 can be freely changed with respect to the rotation of the basic body rotating shaft 11.

Accordingly, when the second gear 20 and the third gear 21 are moved in the axial direction by moving the supporting shaft 22 in the axial direction, the second gear 20 and the fourth gear 13 as gears on a downstream side of driving transmission are moved by this movement in accordance with engaging tooth faces of the first gear 12 and the third gear 21 as gears on an upstream side of the driving transmission in a gear pair having helical gears among the gear pair of the first gear 12 and the second gear 20 and the gear pair of the third gear 21 and the fourth gear 13. A rotating phase of each of the second gear 20 and the fourth gear 13 is changed by its torsional angle. This rotating phase is concentrated to the fourth gear 13 on a most downstream side of the four gears. As a result, the fourth gear 13 is angularly displaced with respect to the basic body rotating shaft 11 and the rotating phase of the fourth gear 13 is changed with respect to the rotation of the basic body 10. When both the first gear 12 and the fourth gear 13 are set to helical gears as in this embodiment mode, the rotating phase of the fourth gear 13 can be more greatly changed by a combination of torsional directions of both the first gear 12 and the fourth gear 13. Namely, when the torsional directions of the helical gears of the fourth gear 13 and the first gear 12 are set to reverse directions, the rotating phase of the fourth gear 13 can be more greatly changed even when a moving amount of the supporting shaft 22 in the axial direction is equal.

A rotating phase of the fifth gear 14 arranged integrally with the fourth gear 13 is changed with respect to the rotation of the basic body 10 by changing the rotating phase of the fourth gear 13. The plural sixth gears 15 each engaged with the fifth gear 14 are simultaneously angularly displaced with respect to the basic body 10 by changing this rotating phase of the fifth gear 14. Accordingly, the plural shafts 102*a*, 102*b* attaching the sixth gears 15 thereto are angularly displaced. When the shafts 102*a*, 102*b* are angularly displaced, the block member 104 is moved in a radial direction of the basic body 10 by an angular displacing action of the eccentric portion 103 arranged integrally with the shafts 102*a*, 102*b*. Thus, the outer circumferential member 105 attached to the block member 104 is also moved in the radial direction of the basic body 10. As a result, the outer circumferential member 105 is projected outward from the outer circumferential face of the basic body 10, or is recessed inward. The outside diameter of the folding cylinder 1 is adjusted by moving this outer circumferential member 105 in the radial direction.

An adjusting amount of the outside diameter of this folding cylinder 1 is proportional to a rotating amount of the male screw member 24. Therefore, the adjusting amount of the outside diameter of the folding cylinder 1 can be indirectly detected by detecting the rotating amount of the male screw member 24. In this embodiment mode, this adjusting amount is detected by a potentiometer 28 operated through the gear 27*a* for a potentiometer attached to the male screw member 24 and the gear 27*b* for a potentiometer engaged with this gear 27*a*.

In this adjustment of the outside diameter of the folding cylinder 1, the angular displacing force giving means 106 gives force for angularly displacing the shafts 102*a*, 102*b* in one direction at any time to the shafts 102*a*, 102*b*. Namely, the angular displacing force giving means 106 gives this force such that each sixth gear 15 is angularly displaced in one direction at any time through the shafts 102*a*, 102*b*. A tooth face on an engaging side of the sixth gear 15 and the fifth gear 14 is maintained such that this tooth face is not changed at any time irrespective of an angular displacing direction of the fifth gear 14. Therefore, no adjustment of the outside diameter of the folding cylinder 1 is influenced by a backlash between the fifth gear 14 and the sixth gear 15.

Further, the force of the angular displacing force giving means 106 is applied from the sixth gear 15 to the fourth gear 13 rotated integrally with the fifth gear 14 through the fifth gear 14. The angular displacing force giving means 106 maintains a tooth face on an engaging side of the fourth gear 13 and the third gear 21 such that this tooth face is not changed at any time when the rotation of the folding cylinder 13 is accelerated and decelerated, etc. In addition to this, this force of the angular displacing force giving means 106 is also applied from the fourth gear 13 to the second gear 20 rotated integrally with the third gear 21 through the third gear 21. The angular displacing force giving means 106 also maintains a tooth face on an engaging side of the second gear 20 and the first gear 12 such that this tooth face is not changed at any time when the rotation of the folding cylinder 1 is accelerated and decelerated, etc.

Accordingly, the influence of the backlash between the sixth gear 15 and the fifth gear 14 can be removed in the adjustment of the outside diameter of the folding cylinder 1 by operating the angular displacing force giving means 106. Further, the influence of backlashes between all the gears relating to an adjusting operation can be removed.

In the embodiment mode of this invention explained above, a torsion spring is arranged in the angular displacing force giving means 106 between one side face of the eccentric portion 103 of each of the shafts 102*a*, 102*b* and an inner face of the side plate 100*a* of the basic body 10 in the first embodiment mode shown in FIG. 1 such that this torsion spring is approximately concentrically located with respect to each of axes of the shafts 102*a*, 102*b*. In an unillustrated second embodiment mode of the angular displacing force giving means 106, a torsion spring may be also arranged between a side face of the sixth gear 15 and an outside face of the side plate 100*a* of the basic body 10 such that this torsion spring is approximately concentrically located with respect to each of the axes of the shafts 102*a*, 102*b*. Further, in an unillustrated third embodiment mode of the angular displacing force giving means 106, a torsion spring may be also arranged between the other side face of the eccentric portion 103 of each of the shafts 102*a*, 102*b* and an inside face of the side plate 100*b* of the basic body 10 such that this torsion spring is approximately concentrically located with respect to each of the axes of the shafts 102*a*, 102*b*. In this case, in the angular displacing force giving means 106 in the third embodiment mode, biasing force of the torsion spring is transmitted between ends of the shafts 102*a*, 102*b* from ends of the shafts 102*a*, 102*b* to the sixth gear 15 so that useless torsion is caused. Therefore, a difference in rotating phases of the shafts 102*a*, 102*b* is caused in the axial direction. There is a possibility that a difference in position of the outer circumferential member 105 arranged in parallel with axial directions of the shafts 102*a*, 102*b* with respect to the outer circumferential face of the basic body 10 is caused by this difference in rotating phases. In the first and second embodiment modes of the angular displacing force giving means 106, there is almost no fear of generation of torsion of the shafts 102*a*, 102*b*. Accordingly, the outside diameter of the folding cylinder 1 can be adjusted more precisely in comparison with the third embodiment mode.

A cam mechanism, a link mechanism, a plane slide mechanism connected in association with functions of these mechanisms, and a mechanism having electric mounting parts within the rotating folding cylinder are not arranged in the adjustment of the outside diameter of the folding cylinder. Accordingly, precise processing parts are reduced and the outside diameter adjusting structure can be simplified. Therefore, breakdown frequency is reduced and maintenance and repair works can be easily made. Further, initial cost is reduced.

Since parts repeatedly deformed by a repeating load are removed in the adjustment of the outside diameter of the folding cylinder, there is no fear of damage of parts due to the repeating deformation.

Further, there is no fear of generation of plays such as backlashes, etc. of many gears in operating transmission in the adjustment of the outside diameter of the folding cylinder. Accordingly, accuracy of the adjustment of the outside diameter of the folding cylinder is improved.

The priority document here, Japanese patent application JP 11-141233 filed May 21, 1999, is hereby incorporated by reference.

We claim:

1. An outside diameter adjuster of a folding cylinder characterized in that the outside diameter adjuster comprises a basic body having a columnar outer circumferential face; a basic body rotating shaft rotated integrally with the basic body; a first gear rotated integrally with the basic body rotating shaft; a fourth gear having the same rotating center as the basic body rotating shaft and rotatable with respect to the basic body rotating shaft; and an outside diameter adjusting operating mechanism in which this mechanism has a second gear engaged with the first gear and also has a third gear engaged with the fourth gear and rotating centers of the second and third gears are set to the same rotating center, and the second and third gears are integrally rotated and can be moved in an axial direction of this rotating center; the basic body has a groove, an angular displaceable shaft arranged in the groove and angularly displaceable within the basic body in parallel with the basic body rotating shaft, angular displacing force giving means for giving force for angularly displacing the angular displaceable shaft in one direction at any time, an eccentric portion angularly displaced integrally with the angular displaceable shaft, and an outer circumferential member forming one portion of the outer circumferential face of the basic body and movable in a radial direction of the basic body by the angular displacement of the eccentric portion; a sixth gear rotatable integrally with the angular displaceable shaft is arranged in this angular displaceable shaft; a fifth gear is engaged with the sixth gear and has the same rotating center as the basic body rotating shaft and the fourth gear and is rotated integrally with the fourth gear and is arranged such that a rotating phase of the fifth gear with respect to the basic body can be changed; and at least one of a gear pair of the first and second gears engaged with each other and a gear pair of the third and fourth gears is mutually constructed by helical gears.

2. An outside diameter adjuster of a folding cylinder as defined in claim 1, wherein all of the first, second, third and fourth gears are helical gears.

3. An outside diameter adjuster of a folding cylinder as defined in claim 2, wherein torsional directions of teeth of the first and fourth gears are set to the same direction.

4. An outside diameter adjuster of a folding cylinder as defined in claim 3, wherein the second and third gears are an integrated gear having a wide tooth width.

5. An outside diameter adjuster of a folding cylinder as defined in claim 2, wherein torsional directions of teeth of the first and fourth gears are set to reverse directions.

6. An outside diameter adjuster of a folding cylinder as defined in claim 5, wherein the second and third gears are double helical gears having a suitable middle groove.

7. An outside diameter adjuster of a folding cylinder characterized in that the outside diameter adjuster comprises a basic body having a columnar outer circumferential face; a basic body rotating shaft rotated integrally with the basic body; a first gear rotated integrally with the basic body rotating shaft; a fourth gear having the same rotating center as the basic body rotating shaft and rotatable with respect to the basic body rotating shaft; and an outside diameter adjusting operating mechanism in which this mechanism has a second gear engaged with the first gear and also has a third gear engaged with the fourth gear and rotating centers of the second and third gears are set to the same rotating center, and the second and third gears are integrally rotated and can be moved in an axial direction of this rotating center; the basic body has a groove, an angular displaceable shaft arranged in the groove and angularly displaceable within the basic body in parallel with the basic body rotating shaft, an eccentric portion angularly displaced integrally with the angular displaceable shaft, and an outer circumferential member forming one portion of the outer circumferential face of the basic body and movable in a radial direction of the basic body by the angular displacement of the eccentric portion; a sixth gear rotatable integrally with the angular displaceable shaft is arranged in this angular displaceable shaft; a fifth gear is engaged with the sixth gear and has the same rotating center as the basic body rotating shaft and the fourth gear and is rotated integrally with the fourth gear and is arranged such that a rotating phase of the fifth gear with respect to the basic body can be changed; and at least one of a gear pair of the first and second gears engaged with each other and a gear pair of the third and fourth gears is mutually constructed by helical gears.

8. An outside diameter adjuster of a folding cylinder characterized in that the outside diameter adjuster comprises a basic body having a columnar outer circumferential face; a first gear rotated integrally with the basic body; a fourth gear having the same rotating center as the basic body and rotatable with respect to the basic body; and an outside diameter adjusting operating mechanism in which this mechanism has a second gear engaged with the first gear and also has a third gear engaged with the fourth gear and rotating centers of the second and third gears are set to the same rotating center, and the second and third gears are integrally rotated and can be moved in an axial direction of this rotating center; the basic body has a groove, an angular displaceable eccentric portion arranged in the groove and angularly displaceable within the basic body in parallel with the basic body, and an outer circumferential member forming one portion of the outer circumferential face of the basic body and movable in a radial direction of the basic body by the angular displacement of the eccentric portion, a sixth gear rotatable integrally with the angular displaceable eccentric portion; a fifth gear is engaged with the sixth gear and has the same rotating center as the basic body and the fourth gear and is rotated integrally with the fourth gear and is arranged such that a rotating phase of the fifth gear with respect to the basic body can be changed; and at least one of a gear pair of the first and second gears engaged with each other and a gear pair of the third and fourth gears is mutually constructed by helical gears.

* * * * *